US009596894B2

(12) United States Patent
Carlson

(10) Patent No.: US 9,596,894 B2
(45) Date of Patent: Mar. 21, 2017

(54) PAD INCORPORATING SHEAR-THICKENING MATERIAL

(71) Applicant: Larry E. Carlson, Santa Clarita, CA (US)

(72) Inventor: Larry E. Carlson, Santa Clarita, CA (US)

( * ) Notice: Subject to any disclaimer, the term of this patent is extended or adjusted under 35 U.S.C. 154(b) by 751 days.

(21) Appl. No.: 13/829,713

(22) Filed: Mar. 14, 2013

(65) Prior Publication Data

US 2014/0259326 A1 Sep. 18, 2014

(51) Int. Cl.

| | |
|---|---|
| ***A41D 13/015*** | (2006.01) |
| ***A42B 3/12*** | (2006.01) |
| ***F41H 1/02*** | (2006.01) |
| *A41D 13/06* | (2006.01) |

(52) U.S. Cl.

CPC ..... *A41D 13/015* (2013.01); *A42B 3/121* (2013.01); *F41H 1/02* (2013.01); *A41D 13/065* (2013.01)

(58) Field of Classification Search

CPC ..... A41D 13/015; A41D 13/065; A42B 3/121
See application file for complete search history.

(56) References Cited

U.S. PATENT DOCUMENTS

| | | | | |
|---|---|---|---|---|
| 3,833,952 | A | 9/1974 | Rosenberg | |
| 4,242,380 | A | 12/1980 | Courtoy | |
| 5,423,087 | A | 6/1995 | Krent | |
| 5,712,011 | A | 1/1998 | McMahon | |
| 6,913,802 | B1 * | 7/2005 | Plant | A41D 13/015 428/152 |
| 7,608,314 | B2 * | 10/2009 | Plant | A41D 31/005 428/116 |
| 7,650,648 | B2 | 1/2010 | Roberts | |
| 8,087,101 | B2 | 1/2012 | Ferguson | |
| 8,510,863 | B2 * | 8/2013 | Ferguson | A41D 31/005 2/69 |
| 8,863,634 | B1 * | 10/2014 | Lou | F41H 5/0464 89/36.02 |

(Continued)

FOREIGN PATENT DOCUMENTS

| | | | |
|---|---|---|---|
| EP | 1159352 | B1 | 8/2006 |
| EP | 2109374 | A2 | 10/2009 |

(Continued)

*Primary Examiner* — Arti Singh-Pandey
(74) *Attorney, Agent, or Firm* — Lowe Graham Jones PLLC

(57) ABSTRACT

A pad is disclosed that includes first and second outer layers. The outer layers include a plurality of channels at least partially filled with shear-thickening fluid. A shear layer is positioned between the first and second outer layers. The first and second outer layers may include first and second sheets that are bonded to one another in bonded portions and not bonded to one another in non-bonded portions such that the channels are defined by the non-bonded portions. The bonded portions may be perforated to facilitate air flow. The shear layer includes a lattice structure such as a plurality of rods extending between the first and second outer layers and oriented at a non-perpendicular angle to the outer layers. The rods themselves may be filled with shear-thickening fluid. The channels in the outer layers are criss-crossed to form a lattice or network in the plane of the outer layers.

21 Claims, 4 Drawing Sheets

(56) References Cited

U.S. PATENT DOCUMENTS

| | | | | |
|---|---|---|---|---|
| 2002/0002730 | A1 | 1/2002 | Dennis | |
| 2008/0282876 | A1* | 11/2008 | Leivesley | A62D 5/00 89/36.02 |
| 2011/0039087 | A1 | 2/2011 | Cauvin | |
| 2012/0021167 | A1* | 1/2012 | Plant | A41D 13/0156 428/116 |
| 2013/0061739 | A1* | 3/2013 | Cheong | F41H 5/007 89/36.02 |

FOREIGN PATENT DOCUMENTS

| | | | |
|---|---|---|---|
| EP | 2174978 | A1 | 4/2010 |
| EP | 2205329 | A2 | 7/2010 |
| EP | 2324910 | A2 | 5/2011 |

* cited by examiner

PAD INCORPORATING SHEAR-THICKENING MATERIAL

FIELD OF THE INVENTION

This application relates to pads worn to protect the body of the wearer, such as sports pads.

BACKGROUND OF THE INVENTION

Shear-thickening fluids or "dilatant" materials have the unusual property of a viscosity that increases with the rate of shear strain within the fluid. Several structures have been offered that attempt to exploit this property by incorporating shear-thickening fluids into fabrics or pads. In some prior approaches, this is accomplished by encapsulating a wet phase shear-thickening fluid into sealed bags, with syntactic glass beads for weight reduction. Other approaches incorporate the shear-thickening fluid into solid phase elastomers. The structures stiffen on impact thereby spreading the impact force over a relatively wide area, with more stiffness at higher speeds for protection and less at lower speeds for movement and comfort. The shear-thickening material is therefore used to improve pad dynamics.

The degree of dynamic variation in pad properties can be modified in these prior approaches according to the amount of dilatant, its formulation (e.g. amount of silicone beads by volume, bead shape, and bead size). A direct result of tuning the dynamic response of a pad is the impact speed at which the material starts to harden, and the resultant load spreading in the pad. Where low weight is desirable, products incorporating shear-thickening fluids are often rated by the amount of shear-thickening reaction available, divided by the area weight. Examples where weight is critical are helmet pads, body armor, gloves, and safety equipment.

In view of the foregoing, it would be an advancement in the art to provide a pad incorporating a shear-thickening fluid that provides both comfort and impact resistance as well as being lightweight.

SUMMARY OF THE INVENTION

In one aspect of the invention, a pad includes first and second outer layers. The outer layers each include a plurality of channels at least partially filled with shear-thickening fluid. A shear layer is positioned between the first and second outer layers. The first and second outer layers may each include first and second sheets that are bonded to one another in bonded portions and not bonded to one another in non-bonded portions. The channels are defined by the non-bonded portions. The bonded portions may be perforated to facilitate air flow.

In another aspect of the invention, the shear layer includes a rigid or semi-rigid polymer and one or both of the outer layers include a rigid polymer.

In another aspect of the invention, the shear layer includes a lattice structure defining straight shear paths between the first and second outer layers. For example, the lattice structure may include a plurality of webs or rods, such as cylindrical rods, extending between the first and second outer layers. The rods may be angled with respect to the outer layers, such that the smallest included angle between a rod and the outer layers is less than 85 degrees. The rods themselves may be hollow and filled with shear-thickening fluid. The plurality of rods may have a buckling point effective to cause buckling of the rods at a first loading that is less than a second loading at which failure of either of the first and second outer layers occurs. The rods may cross one another and secure to one another at a crossing point. The rods may include a hydrophilic coating to wick moisture between the outer layers.

In another aspect of the invention, the channels in the outer layers are criss-crossed to form a lattice or network in the plane of the outer layers. For example, the channels may include first channels oriented at either of 45 degrees and −45 degrees with respect to a common reference direction in a plane. The channels may also include second channels oriented parallel to the reference direction in the plane and third channels oriented perpendicular to the reference direction in the plane.

Methods for manufacturing a pad incorporating shear-thickening fluid are also disclosed and claimed herein.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1:
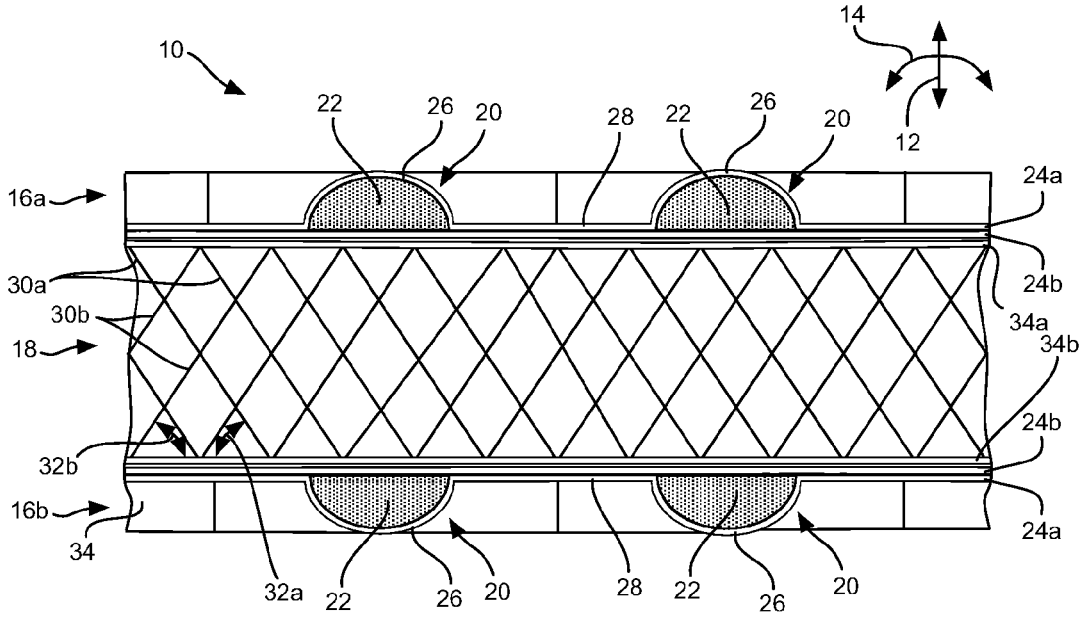
FIG. 1 is a side cross-sectional view of a pad incorporating shear-thickening fluid in accordance with an embodiment of the present invention.

FIG. 1 illustrates a pad 10 that provides the impact resistance of a shear-thickening fluid while at the same time being lightweight and breathable. The pad 10 advantageously provides a different pad dynamic for different types of loads. In particular, the pad dynamic for compressive loads along a compression direction 12 may be different from a pad dynamic in response to a dynamic load in a bending direction 14. In particular, as will be described in greater detail below, the illustrated pad 10 may be able to stiffen in bending when subject to an impact, thereby distributing loads outward from an impact point and lowering the pressure on the body of a wearer. In contrast, when no impact is present, the pad 10 may advantageously be less stiff in compression and thereby be more comfortable to the wearer as the pad is compressed during ordinary use.

The illustrated pad 10 may include first and second outer layers 16*a*, 16*b* that are secured to opposing sides of a shear layer 18. The shear layer 18 transfers shear loads between the first and second outer layers 16*a*, 16*b* during bending of the pad 10 and provides cushioning for compressive loads imposed on the pad 10. The outer layers 16*a*, 16*b* incorporate a shear-thickening fluid, which may be mixed with beads, such as silicone beads, to tune the degree of shear thickening. In some embodiments, the outer layers 16*a*, 16*b* may incorporate a polymer mixed with, or encapsulating, a shear-thickening fluid such that the combination has both elasticity and shear-thickening properties. For example, the outer layers 16*a*, 16*b* may include such materials as D30™, Zoombang™, or Deflexion™. When a member is bent, the bending loads are born by the outer layers of the member. Accordingly, incorporating the shear-thickening fluid in the outer layers increases the ability of the pad 10 to react to bending forces due to impacts.

In the illustrated embodiment, the outer layers 16*a*, 16*b* define one or more channels 20 or a network of interconnected channels 20. The channels 20 are completely or partially filled with shear-thickening fluid 22. The amount of the area of the outer layers 16*a*, 16*b* that is covered or otherwise coextensive with the channels 20 of that layer may be substantially less than the surface area of the outer layers 16*a*, 16*b*. For example, the channels 20 may be occupy an area in a plane or contour that is less than 60%, preferably less than 50%, and more preferably less than 25%, of the total area of the outer layer 16*a*, 16*b* in the same plane or contour or a parallel plane or contour.

In the illustrated embodiment, the channels 22 are positioned between 24*a*, 24*b* such that the shear-thickening fluid 22 is captured between the sheets 24*a*, 24*b*. The shear-thickening fluid 22 may be contained tubes that are positioned within the sheets 24*a*, 24*b* or may be contained by the sheets 24*a*, 24*b* alone. For example, one or both of the sheets may define ridges 26 such that a concave inner surface of the ridges 26 defines the channel 20. One or both of the sheets 24*a*, 24*b* may be flexible such that the presence of the shear-thickening material deforms one or both of the sheets 24*a*, 24*b* to define the channels 20. Alternatively, the sheets 24*a*, 24*b* may be made of a rigid or semi-rigid polymer that maintains its shape such that the ridges 26 are defined by molding or otherwise forming one or both of the sheets 24*a*, 24*b*. For example, one or both of the sheets 24*a*, 24*b* may be formed from a rigid polymer such as polyvinyl chloride (PVC), polycarbonate, acrylonitrile butadiene styrene (ABS), or other plastic. For purposes of this disclosure a rigid polymer is a polymer with a modulus of elasticity greater than 0.6 GPa and a semi-rigid polymer is a polymer that has a modulus of elasticity of between 0.01 GPa and 0.2, preferably between 0.02 and 0.1 GPa.

In some embodiments, the sheets 24*a*, 24*b* are bonded to one another at bonded areas 28 between the channels 20 (e.g. ridges 26) and not bonded to one another at the locations occupied by the channels 20. The sheets 24*a*, 24*b* may be bonded to one another by any means, such as heat sealing, adhesive, polymer welds, or other fastening means. In some embodiments, the channels 20 are formed by applying shear-thickening fluid to one of the sheets 24*a*, 24*b* and then selectively forcing the fluid out of the bonded areas 28 and bonding the bonded areas 28 of the sheet 24*a* to the sheet 24*b*. The fluid remaining in the non-bonded areas between the bonded areas 28 becomes the shear-thickening fluid 22. One or both of the sheets 24*a*, 24*b* may deform during bonding to define the channels 20 or one or both of the sheets 24*a*, 24*b* may be formed to include the ridges 26 defining channels 20. In some embodiments, the areas of the outer layers 16*a*, 16*b* not occupied by the channels 20, such as the bonded areas 28, may be perforated to allow airflow therethrough.

The shear layer 18 may be formed of any compressible material, semi-rigid material, or crushable material in order to advantageously use outer layers 16*a*, 16*b* as described above. For example, the shear layer 18 may be formed of a honeycombed material with apertures thereof either parallel or perpendicular to the compression direction 12. For example, a honeycombed structure formed of Nomex™, aluminium, a polymer, or other lightweight material may be used for the shear layer 18. The shear layer may be rigid or semi-rigid due to one or both of the materials used and the geometry of structures defining the shear layer 18. In the illustrated embodiment the shear layer 18 has a lattice structure that defines open spaces allowing airflow thereacross. For example, the shear layer 18 may define rods 30*a*, 30*b* that extend between the outer layers 16*a*, 16*b*. The rods 30*a*, 30*b* may have a hydrophilic coating that enables the rods 30*a*, 30*b* to conduct moisture between the outer layers 16*a*, 16*b*. The shear layer 18 may secure to the outer layers 16*a*, 16*b* directly or through an intermediate layer, such as a thin laminate sheet having an outer layer 16*a*, 16*b* adhered to one surface and the shear layer 18 adhered to an opposing surface. Adhesion between various layers of the pad 10 may be accomplished by glue, thermal bonding, plastic welds, stitching, rivets, or any other fastening means.

In particular, the rods 30*a*, 30*b* may define straight shear paths between the outer layers 16*a*, 16*b*. Each rod 30*a* may cross one or more rods 30*b* and secure to the one or more rods 30*b* at the point of crossing. Securement of rods 30*a* to rods 30*b* to one another may hinder premature buckling of the rods 30*a*, 30*b*. The rods 30*a* define an angle 32*a* with respect to the outer layers 16*a*, 16*b* and the rods 30*b* define an angle 32*b* with respect to the outer layers 16*a*, 16*b*. The angles 32*a*, 32*b* are preferably less than 90 degrees. For example, the smallest included angle between a rod 30*a*, 30*b* and an outer layer 16*a*, 16*b* may be less than 85 degrees. Where the outer layers 16*a*, 16*b* are contoured, the angles 32*a*, 32*b* may be defined relative to a plane tangent to one or both of outer layers 16*a*, 16*b* at a point closest to an end of a rod 30*a*, 30*b*, respectively.

In the illustrated embodiment, the rods 30*a*, 30*b* are secured to outer sheets 34*a*, 34*b*, such as at the ends thereof. The sheets 34*a*, 34*b* may then be bonded to the outer layers 16*a*, 16*b*, such as to the sheets 24*b* of the outer layers 16*a*, 16*b*. In other embodiments, ends of the rods 30*a*, 30*b* secure directly to the outer layers 16*a*, 16*b*, such as to the sheets 24*b* thereof.

The illustrated orientation of the rods 30*a*, 30*b* may be viewed as a projection of the paths followed by the rods 30*a*, 30*b* onto the page. In some embodiments, the projection of the paths followed by the rods 30*a* 30*b* onto a vertical plane perpendicular to the page may be the same or different. In some embodiments, the projection of the paths followed by the rods 30*a*, 30*b* onto the vertical plane perpendicular to the page may likewise be angled with respect to the outer layers 16*a*, 16*b*. In some embodiments, the rods 30*a*, 30*b* may be replaced with continuous sheets of material that extend perpendicular to the page along the paths shown for the rods 30*a*, 30*b* in FIG. 1. The intersections of the sheets 30*a*, 30*b* therefore would define tunnels extending perpendicular to the plane of the page.

The rods 30*a*, 30*b* may be formed of a rigid or semi-rigid material that enables the rods 30*a*, 30*b* to compress in response to forces along the compressive direction 12. The rods 30*a*, 30*b* may have a round cylindrical shape or some other cross-sectional shape. In some embodiments, the buckling force per unit area of an area occupied by the rods 30*a*, 30*b* may be chosen to be less than a maximum force per unit area at which one or both of the outer layers 16*a*, 16*b* fail in order to avoid failure of the outer layers 16*a*, 16*b* in response to large impact forces. In some embodiments, the rods 30*a*,

30*b* are hollow and may contain shear-thickening fluid as well. The presence of the shear-thickening fluid in the rods 30*a*, 30*b* may be such that the rods 30*a*, 30*b* are more permissive to buckling at slower load rates and more resistant to buckling at higher load rates.

In some embodiments, a shear layer 18 as described herein may be incorporated between outer layers 16*a*, 16*b* without a shear-thickening material. For example, one or both of the outer layers 16*a*, 16*b* may be formed of a flexible, rigid, or semi-rigid material that is capable of resisting tensile and compressive forces due to bending of the pad 10. For example, one or both of the outer layers 16*a*, 16*b* may be formed of fabric, coated and/or contoured fabric, or other type of material that can be formed into sheets and is capable of resisting tensile and compressive forces. In some embodiments, one or both of the outer layers 16*a*, 16*b* including a shear-thickening fluid as described above may have a cover layer secured to an outer surface thereof (e.g. opposite the shear layer 18 with respect to the outer layer 16*a*, 16*b*). For example, a cover sheet may adhere to the sheet 24*b* or other structure defining the channels 20 of a layer 16*a*, 16*b*.

Figure 2:
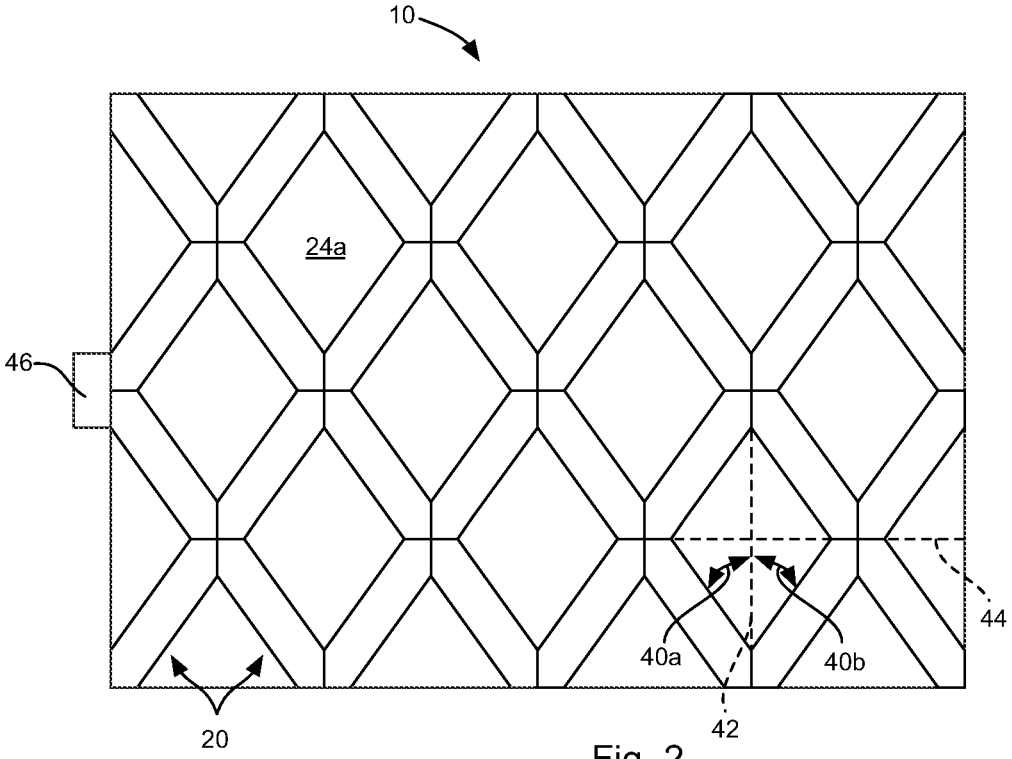
FIG. 2 is a top view of a pad incorporating shear-thickening fluid in accordance with an embodiment of the present invention.

FIG. 2 is a top view of a pad 10. In some embodiments, the channels 20 are angled with respect to one another and form a lattice or grid of channels 20. For example, a first portion of the channels 20 may define an angle 40*a* with respect to a reference direction 42, such as an edge of the pad 10 or any arbitrary direction in the plane of the page, whereas a second portion of the channels 20 define an angle 40*b* with respect to the same reference direction. The angles 40*a* may be equal and opposite or unequal and opposite in sign. For example, in the illustrated embodiment, the angles 40*a*, 40*b* may be −45 and 45 degrees, respectively, or some other value. In some embodiments, a third portion of the channels 20 is parallel to the reference direction 42. In some embodiments, a fourth portion of the channels 20 is perpendicular to the reference direction 42, i.e. direction 44. The different portions of the channels 20 may be in fluid communication with one another at the nodes where the channels 20 intersect one another. In other embodiments, the channels 20 are isolated from one another due to blockages at intersections of different portions of the channels 20.

In some embodiments, a port 46 may be defined by one or both of the sheets 24*a*, 24*b* or secure to one or both of the sheets 24*a*, 24*b*. The port 46 is in fluid communication with at least one of the channels 20. Shear-thickening fluid may be forced into the channels 20 by means of the port 46. In some embodiments, an exhaust port may be secured to or defined by the one or both of the sheets 24*a*, 24*b* to enable air to exit the channels 20 as the fluid is pumped in. The port 46 and any exhaust port may be selectively sealable by placement of a cap thereon or by crushing the port 46 and adhering opposing inner surfaces of the port 46 to one another by adhesives, heat sealing, or other sealing means.

Figure 3:
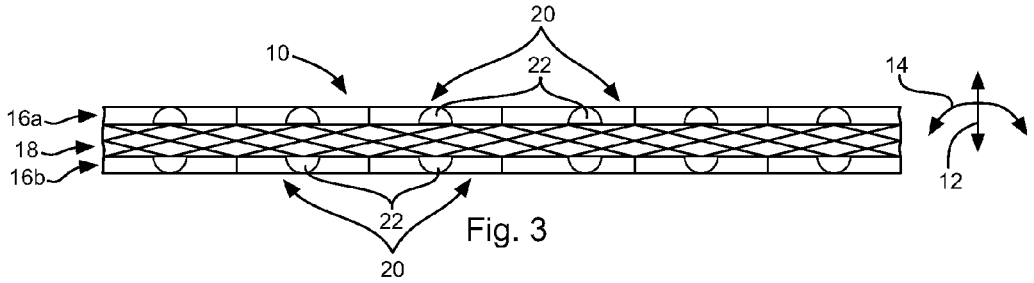
FIG. 3 is a side cross-sectional view of a pad in accordance with an embodiment of the present invention under compression.

FIG. 3 illustrates a pad 10 when subject to compression along a compression direction 12 that is perpendicular to the plane of the layers 16*a*, 16*b*, 18 of the pad 10. As is apparent, the shear layer 18 compresses. Inasmuch as there is no bending deformation of the channels 20 and the shear-thickening fluid 22 within the channels the pad dynamic is primarily controlled by the elasticity and buckling of the shear layer 18. Accordingly, for compressive loads, the pad dynamic can be very compliant and cushioning to enhance the comfort of the wearer.

Figure 4:
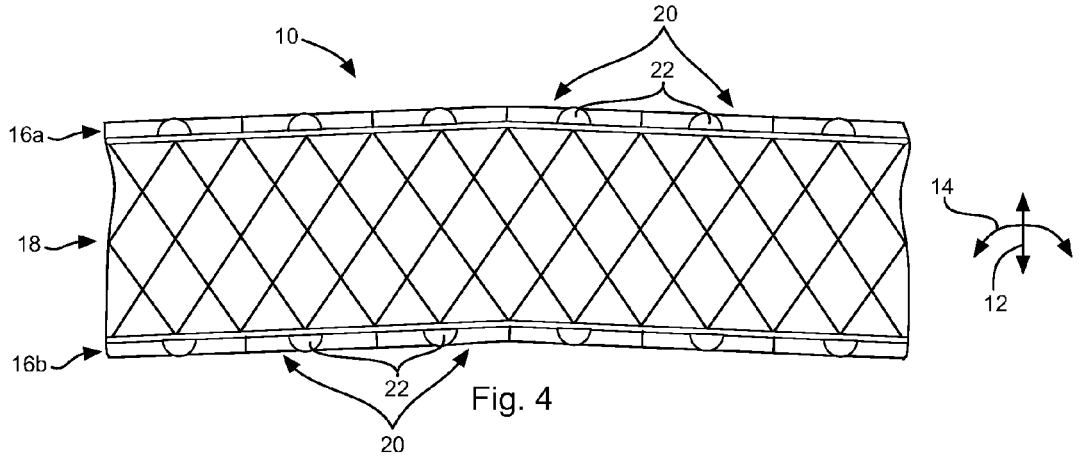
FIG. 4 is a side cross-sectional view of a pad in accordance with an embodiment of the present invention under a bending load.

FIG. 4 illustrates a pad 10 that is subject to a bending load in a bending direction 14, such as bending in a plane perpendicular to the planes of the layers 16*a*, 16*b*, 18 when undeformed. Where the illustrated bending is due to an impact, the bending of the channels 20 and the corresponding shear forces imposed on the shear-thickening material results in stiffening of one or both of the outer layers 16*a*, 16*b* and a distribution of the impact force across the pad 10, where it can be absorbed by compression of the shear layer and otherwise distributed across a greater extent of the wearer's body. Where a bending force is applied at a lower load rate, i.e. isn't due to an impact, such as due to movement of the wearer of the pad, the shear-stiffening liquid stiffens to a lesser extent and bending of the pad 10 is permitted subject to the inherent resilience of the outer layers 16*a*, 16*b* and the shear and compressive properties of the shear layer 18.

Figure 5:
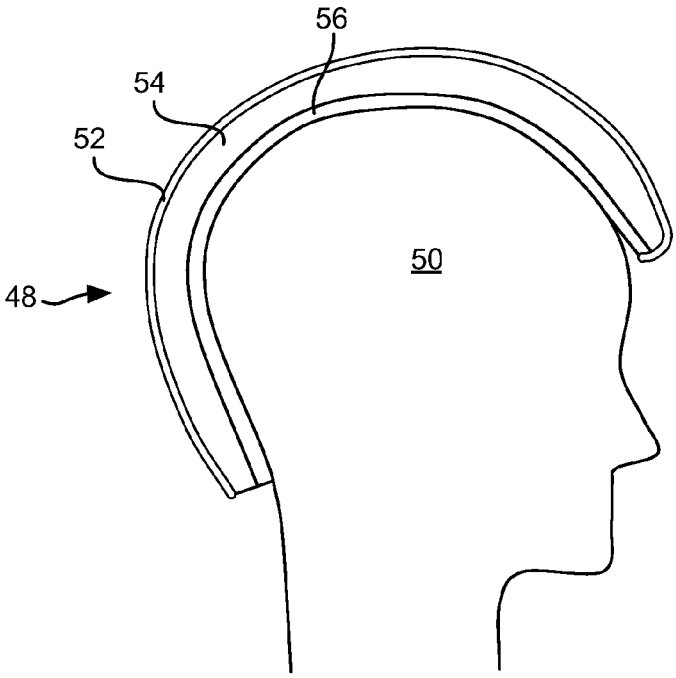
FIG. 5 is a side cross-sectional view of a helmet incorporating a pad in accordance with an embodiment of the present invention.

Referring to FIG. 5, while referring again to FIG. 1, a helmet 48 for wearing on the head 50 of a wearer may incorporate the pad 10 of FIG. 1. A typical helmet 48 may include multiple layers including a hard outer shell 52 to resist punctures and abrasion and to distribute impact forces over a larger area. The helmet 48 may also include a crushable layer 54 that is designed to destructively or non-destructively compress in response to impacts in order to protect the head 50. The helmet 48 may also include a liner 56 made of a soft, compliant material to enhance the comfort of the wearer by providing a soft surface in contact with the skin, wicking of moisture away, or other functionality. Any individual layer 52, 54, 56 may incorporate a pad as described hereinabove. As noted above a pad according to the embodiments described herein may define a rigid outer layer 16*a*, 16*b* (FIG. 1). Accordingly, the pad 10 of FIG. 1 may be used to form a shell 52. The impact resistance and compressibility of the pad described herein may also be suitable for implementing a crushable layer 54. Where the pad is made of sufficiently compliant materials, a pad according to the embodiments disclosed herein may also be suitable as a liner 56 for a helmet 50.

In other embodiments, a pad as described herein may serve as multiple layers. For example the outer layer 16*a* (see FIG. 1) may be formed of a rigid material and define the shell 52. The shear layer 18 (see FIG. 1) may serve as the crushable layer 54. The outer layer 16*b* (see FIG. 1) may be formed of a sufficiently compliant material to form the liner 56 or a suitable liner 56 may be adhered to or otherwise fasten to the outer layer 16*b*.

Figure 6A:
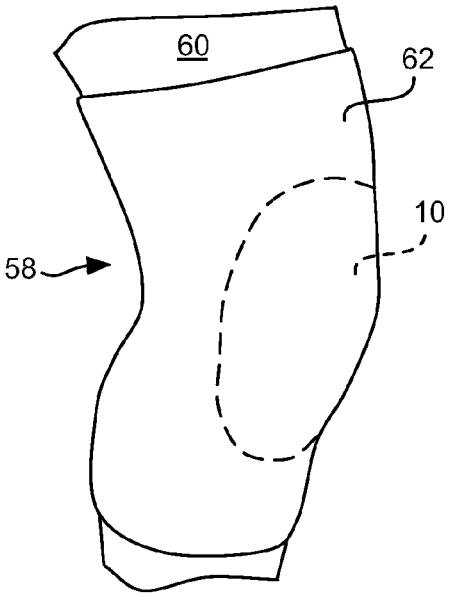
FIG. 6A is an isometric view of a wearable item incorporating a pad in accordance with an embodiment of the present invention.
Figure 6B:
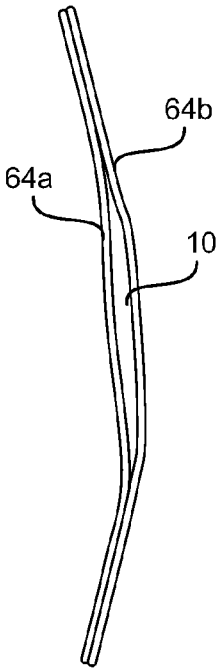
FIG. 6B is a side cross-sectional view of the wearable item of FIG. 6A.

Referring to FIGS. 6A and 6B, a pad 10 as described above may be incorporated into other wearable items, such as the illustrated knee pad 58 for wearing around the leg 60 of a wearer. The kneepad 58 may include a sleeve 62, such as a sleeve 62 formed of an elastic material that encircles the leg 60 of the wearer. A pad 10 may be embedded in the sleeve 62 to be positioned over the patella of the wearer in order to protect the knee of the wearer from injury during sporting or other activities. As shown in FIG. 6B, the pad 10 may be embedded in the knee brace 58 by stitching or otherwise fastening the pad 10 between layers 64*a*, 64*b* of material forming the sleeve 62. In some embodiments, an outer layer 64*b* may include a rigid material for abrasion and impact resistance. The illustrated sleeve 62 and pad 10 may be sized and configured to cover another part of a wearer's body such as an elbow, wrist, shoulder, or other body part. Likewise, the sleeve 62 may be replaced with one or more straps to secure the pad 10 to a wearer's body. The sleeve 62 may also be part of a larger garment, such as a shirt, pants, glove, shoe, body suit, or other article, incorporating one or more pads 10 to protect areas of the wearer's body from injury or discomfort.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A pad comprising:

first and second outer layers each including shear-thickening fluid; and a shear layer positioned between the first and second outer layers;

wherein the first and second outer lavers each comprise first and second sheets, the first and second sheets bonded to one another in bonded portions and not bonded to one another in non-bonded portions, the shear thickening fluid being contained in the non-bonded portions.

2. The pad of claim 1, wherein the bonded portions are perforated.

3. The pad of claim 1, wherein the shear layer comprises a rigid polymer.

4. The pad of claim 1, wherein the shear layer defines a lattice structure defining straight shear paths between the first and second outer layers.

5. The pad of claim 1, wherein the shear layer defines a lattice structure of a plurality of rods extending between the first and second outer layers.

6. The pad of claim 5, wherein the plurality of rods are cylindrical.

7. The pad of claim 5, wherein the plurality of rods define a smallest included angle with respect to the first and second outer layers that is less than 85 degrees.

8. The pad of claim 5, wherein the plurality of rods contain shear-thickening fluid.

9. The pad of claim 5, wherein the plurality of rods have a buckling point effective to cause buckling of the rods at a first loading, the first loading being less than a second loading at which failure of either of the first and second outer layers occurs.

10. The pad of claim 5, wherein at least a portion of the rods of the plurality of rods each cross an adjacent rod of the plurality of rods and are joined to the adjacent rod at a crossing point.

11. The pad of claim 1, wherein the shear layer defines a plurality of openings permitting airflow between therethrough.

12. The pad of claim 1, wherein the first and second outer layers include a rigid polymer.

13. The pad of claim 1, wherein the first and second layers each define a plurality of channels, the shear thickening fluid being contained in the plurality of channels, the plurality of channels including first channels oriented at one of 45 degrees and −45 degrees with respect to a common reference direction in a plane.

14. The pad of claim 13, wherein the plurality of channels include second channels oriented parallel to the reference direction in the plane and third channels oriented perpendicular to the reference direction in the plane.

15. A pad comprising:

first and second outer lavers each including shear-thickening fluid; and a shear layer positioned between the first and second outer lavers;

wherein the shear layer has a hydrophilic coating effective to enable wicking of moisture between the first and second outer layers.

16. A pad comprising:

first and second outer layers each including shear-thickening fluid; and a shear layer positioned between the first and second outer layers;

wherein the shear layer comprises a rigid polymer.

17. The pad of claim 16, wherein the shear layer defines a lattice structure defining straight shear paths between the first and second outer layers.

18. The pad of claim 16, wherein the shear layer defines a lattice structure of a plurality of rods extending between the first and second outer layers.

19. The pad of claim 18, wherein the plurality of rods are cylindrical.

20. The pad of claim 18, wherein the plurality of rods define a smallest included angle with respect to the first and second outer layers that is less than 85 degrees.

21. The pad of claim 18, wherein the plurality of rods contain shear-thickening fluid.

* * * * *